United States Patent [19]

Paole et al.

[11] Patent Number: 4,809,691

[45] Date of Patent: Mar. 7, 1989

[54] BREATHING APPARATUS FOR DIVING

[75] Inventors: Henri Paole, Villemomble; Alain Ronjat, Delle, both of France

[73] Assignee: La Spirotechnique Industrielle et Commerciale, Carros, France

[21] Appl. No.: 76,139

[22] Filed: Jul. 21, 1987

[30] Foreign Application Priority Data

Jul. 21, 1986 [FR] France ..... 86 10532

[51] Int. Cl.[4] ..... B63C 11/02

[52] U.S. Cl. ..... 128/200.29; 128/205.24; 128/204.21

[58] Field of Search ..... 128/205.24, 204.21, 128/200.29

[56] References Cited

U.S. PATENT DOCUMENTS

| | | | |
|---|---|---|---|
| 2,882,895 | 4/1959 | Galeazzi | 128/200.29 |
| 3,101,708 | 8/1963 | Perry et al. | 128/204.21 |
| 3,695,261 | 10/1972 | Emmons | 128/147 |
| 4,640,277 | 2/1987 | Meyer et al. | 128/205.24 |

FOREIGN PATENT DOCUMENTS

| | | |
|---|---|---|
| 1550305 | 11/1968 | France . |
| 1538953 | 1/1969 | France . |
| 2313951 | 6/1976 | France . |
| 2491428 | 10/1980 | France . |

*Primary Examiner*—A. Michael Chambers

*Attorney, Agent, or Firm*—Lee C. Robinson, Jr.

[57] ABSTRACT

Breathing apparatus for diving of the type comprising a breathing bag (13), a mouthpiece (30), inhaling and exhaling ducts (16 and 17) connected to the bag and to the mouthpiece these inhaling and exhaling ducts being respectively provided with inhaling and exhaling non return valves (18 and 19), and a so called "drainage" device. The apparatus further comprises a device (22) for measuring the volume of inhaled and exhaled gas. The draining device comprises a switching means (21) which, in so called "operating" position, is adapted to direct the flow towards the exhaling valve (19), and in so called "non operating" position is adapted to direct the exhaled flow towards an outlet drain (23).

9 Claims, 5 Drawing Sheets

BREATHING APPARATUS FOR DIVING

BACKGROUND OF INVENTION (1) Field of the Invention

The present invention relates to a breathing apparatus for diving, of the type comprising a breathing bag, a mouthpiece, inhaling and exhaling ducts connected to the bag and to the mouthpiece, these inhaling and exhaling ducts being respectively provided with inhaling and exhaling non return valves and a so called "drainage device".

(2) Description of Prior Art

Depending on the use requirements, a breathing apparatus comprises, either one or more bottle(s) of a gas mixture comprising an exact proportion of oxygen and inert gas, for example nitrogen, or one or more bottle(s) of inert gas or gas mixture.

In the latter case, the breathing apparatus comprises means for introducing a suitable proportion of oxygen and inert gas in the bag.

This arrangement is well known and operates in response to the following use requirements.

In such apparatus the partial pressure of the oxygen contained in the mixture inhaled from the bag must remain substantially constant or more specifically should range between two extreme values, called security values, for example between 0.2 bar and 2 bars. This is intended for the safety of the diver, whatever the oxygen consumption, which may for example be between 0.5 l/min. and 2 l/min.

It is therefore absolutely necessary to provide for a concentration of oxygen in the inhaled mixture, which is smaller as depth increases, and consequently the surrounding pressure is itself larger.

The devices of the prior art which operate with a breathing bag and either a bottle comprising a mixture adapted to the zone of the working depths, or a bottle of oxygen and one or more bottle(s) of inert gas with means for mixing the oxygen and the inert gas in a proportion adapted to the depth at which the diver works, meet this requirement.

Such a breathing apparatus should also enable to ensure the following requirement. It is known that the diver absorbs a mixture of oxygen and inert gas and returns a portion containing less oxygen and carbon dioxide , When this return takes place directly in water, there are two well known disadvantages:

there is a waste of gas which could be reused, the gas return in water produces bubbles and renders the presence of the diver relatively detectable.

In a manner well known to those skilled in the art, these disadvantages may be overcome by returning the gas to the breathing bag, from which a fraction of the gas previously returned could be reinhaled, and by incorporating the drainage device in the breathing apparatus, the draining device being adapted to permit rejection of a fraction of the volume of the exhaled gas in water. For example, when diving down, the diver can engage the drainage device, which enables him to reach great depths, by remaining, as regards partial pressure of oxygen, between two extreme safety values, while rejecting only a small portion of the volume of exhaled gas, which produces a condition whereby the diver is relatively unnoticed. As soon as the diver has reached a depth area in which he intends to work and circulate, he can bypass the drainage device and thereby work in closed circuit where there is no rejection of exhaled gas.

Experience and research in the field of skin or scuba diving has indicated that in order to have a good compromise in the rate of oxygen equilibrium in the breathing bag, a relative calm environment when the drainage device is engaged and a consumption of gas, such as inert gas, which is minimized, the fraction of the exhaled gas which is rejected in water should be of the order of 1/10 to 1/15 of the inhaled gas.

A drainage device is described in French patent No. 1,538,952. According to this patent, the apparatus comprises a compressible drainage bag whose volume corresponds to a predetermined fraction (for example 1/12) of the breathing bag, and which is connected thereto. The apparatus also comprises means for filling, when exhaling, the drainage bag essentially with an inert gas, and when inhaling for emptying a good portion of this bag. In this manner, the quantity of gas previously exhaled, and rejected in water during the cycle following inhaling, substantially corresponds, in this example, to 1/12 of the gas inhaled during this inhaling cycle.

This purely mechanical device gives a particularly reliable operation of the entire breathing apparatus. Unfortunately, this device has the disadvantages that it is difficult to operate and to manufacture, and moreover it is particularly cumbersome.

Purely electronic control devices have also been proposed, which essentially consist of means for analyzing the partial pressure of oxygen in the bag, and means to control the means the required quantity of oxygen in the bag.

These devices obviously overcome some of the disadvantages mentioned above, they are seriously deficient due to the fact that the safety of the diver is directly dependent on the good operation of these electronic devices and therefore on their reliability.

SUMMARY OF INVENTION

In this context, the present invention essentially aims at a breathing apparatus of the type mentioned above, comprising a drainage device which is particularly simple to operate, and in particular enables the elimination of the drainage bag of the mechanical device mentioned above, and essentially operates through electromechanical or pneumatic means, said drainage device being convertible to operate essentially mechanically in case of failure of the electromechanical means.

According to the present invention, the breathing apparatus is more particularly characterized by a device for measuring the volume of inhaled gas and a device for measuring the volume of exhaled gas. The drainage device includes a switching means which, in its so called "working" position, is adapted to direct the flow towards the exhaling valve, and in so called "rest" position, is adapted to direct the exhaled flow towards a drainage outlet.

According to another embodiment, the drainage device is disposed in the mouthpiece.

According to an embodiment, the apparatus comprises electronic or pneumatic means connected to said measuring device and said switching device, adapted to control the switching means so that the exhaled flow is directed towards the exhaling valve when a determined fraction of the volume of exhaled gas has been evacuated by the drainage device.

These arrangements result in a breathing apparatus which is only slightly cumbersome, is easy to operate and whose operation involves a minimum of risk.

Indeed, the diver may, at any moment, control the drainage operation by the presence or the absence of bubbles.

In case of a failure of the switching means, the latter will most probably be blocked in rest position, thereby permitting a constant leak. The diver then knows that there is a failure and can take any required measures, for example by engaging a relief device so as to preserve the partial pressure of oxygen mentioned above.

If the switching means is blocked in working position, the diver immediately becomes aware of this fact by the absence of bubbles and can therefore take any measure, for example by engaging a relief device.

BRIEF DESCRIPTION OF DRAWINGS

Other characteristics and advantages of the present invention will appear from the description which follows, with reference to the annexed drawings, in which.

DESCRIPTION OF PREFERRED EMBODIMENTS

Figure 1:
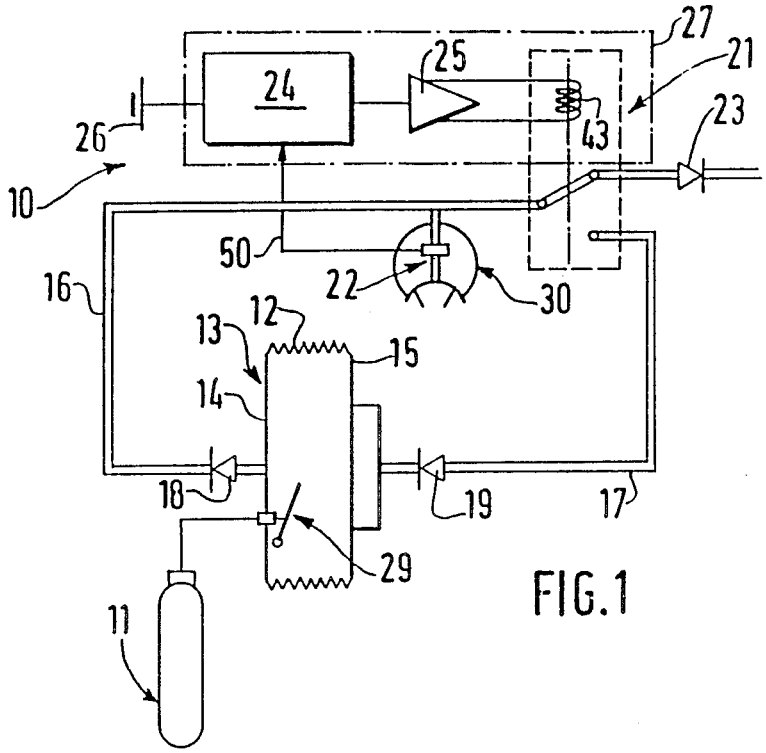
FIG. 1 is a synoptic diagram of an embodiment of the apparatus according to the present invention.

In the embodiment of the invention selected and represented in FIG. 1, a breathing apparatus 10 comprises an inhaling gas (oxygen and nitrogen) mixing bottle 11 connected to a breathing bag 13 shown as a cylindrical bellows 12 disposed between two lower and upper plates 14 and 15. The bag 13 comprises a means well known to those skilled in the art, such as an inlet valve, which is schematically represented at 29 and adapted for introducing the mixture from bottle 11, as soon as the upper plate 15 hits the valve 29 and blocks any admission of the mixture in other cases.

In the embodiment which is represented, the breathing bag 13 is connected to a mouthpiece, which is illustrated herein as a drainage mouthpiece 30. This connection is made possible by means of an inhaling circuit 16 and an exhaling circuit 17. In a well known manner, the inhaling circuit 16 comprises an inhaling non return valve schematically represented at 18. The exhaling circuit 17 comprises an exhaling valve schematically represented at 19.

According to the present invention, the apparatus comprises a switching means which, in a so called "rest" position, schematically represented in FIG. 1, is adapted to direct the exhaled flow towards a so called "leaking" valve 23 and, in a so called "operating" position, is adapted to direct the exhaled flow towards said exhaling valve 19.

In the embodiment represented, this switching means appears as an electromagnetic relay 21.

According to another embodiment of the present invention, the breathing apparatus comprises a device for measuring the inhaled gas and a device for measuring the exhaled gas. In this embodiment, the two devices are connected together into a single volume pick-up 22 disposed in the mouthpiece 30 in the vicinity of the mouth of the diver.

The apparatus according to the present invention also comprises a computer 24 connected to the electromagnetic relay 21 by means of an amplifier 25 and to the volume pick-up 22. A power supply 26 feeds the assembly 27 comprised of the calculator, the amplifier and the coil of the electromagnetic relay.

An embodiment of the mouthpiece of the apparatus will now be described with reference to FIGS. 2 to 4.

Figure 2:
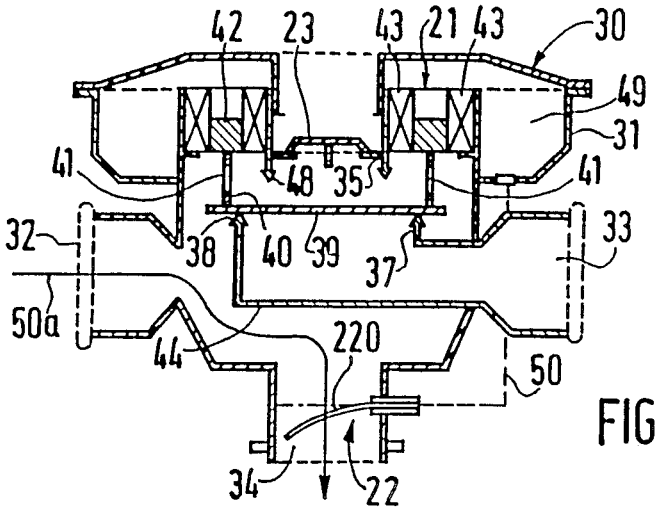
FIGS. 2, 3 and 4 are three schematic views in cross section of an embodiment of a mouthpiece for the apparatus of the present invention, the mouthpiece being represented during the three phases of its operation.
Figure 3:
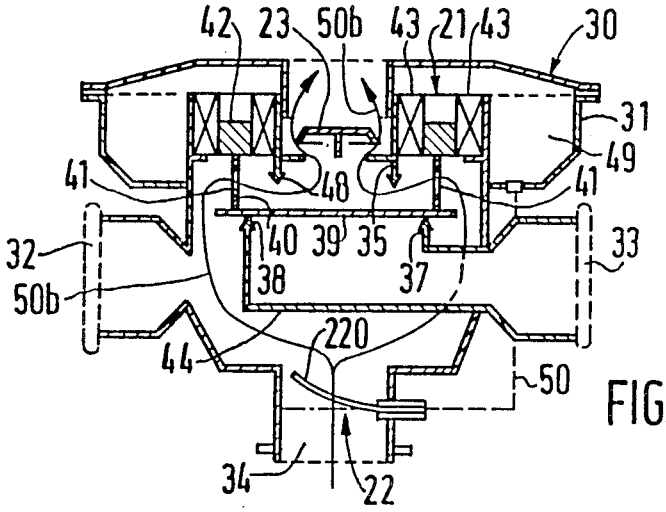
Figure 4:
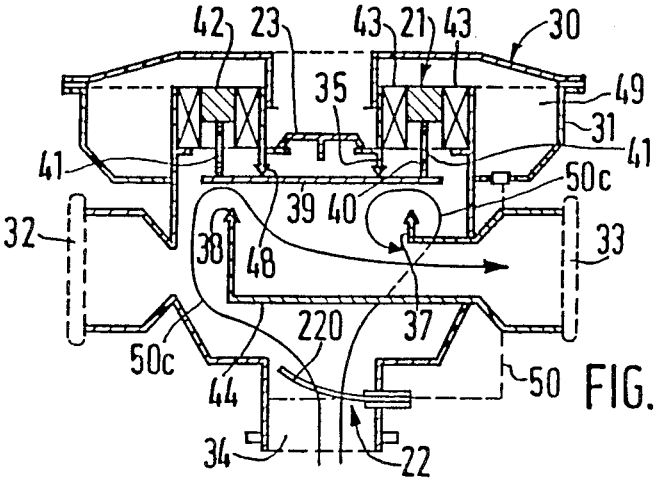

Elements common to FIGS. 2 to 4 will bear identical reference numerals.

The drainage mouthpiece 30 comprises an essentially annular structure 31 comprising a so called "inhaling" duct 32 and a so called "exhaling" duct 33 on which are respectively connected the inhaling and exhaling circuits 16 and 17.

The structure 31 of the drainage mouthpiece 30 comprises a first coaxial outlet 34, so called "mouthpiece outlet", intended to be connected to a rubber element, not illustrated in the drawings, and acting as the mouthpiece per se, which the diver places in his mouth.

According to a characteristic of the invention, the structure 31 comprises a second coaxial outlet 35, so called "leaking" or "drainage" outlet. This outlet is closed by the non return leaking valve 23 preventing any movement of liquid from outside the structure 31 towards its interior.

The exhaling duct 33 extends inside the structure 31 by means of an elbow 44 and opens in the structure 31 by means of a circular inlet 37 provided with a seal schematically illustrated at 38. The inlet 37 is, in this embodiment, coaxial with the entire structure 31.

The inlet 37 and the leaking outlet 35, which includes a joint 48, can be closed by means of the electromagnetic relay 21 which will be described hereinafter.

This electromagnetic relay comprises a closing plate or shutter 39 mounted on a cylinder 40 having a larger diameter than the leaking outlet 35 and including a series of passages 41. The cylinder 40 is unitary with an annular magnetic core 42 which slides inside an annular coil 43 (also schematically represented in FIG. 1).

In this embodiment, the computer 24 and the amplifier 25 are mounted in an annular housing 49 which, in the structure 31, is disposed around the coil 43. These electronic devices have not been represented in FIGS. 2 to 4.

As described with respect to FIG. 1, a volume pick-up 22 is disposed in the mouthpiece 30 near the mouth of the diver. In the embodiment represented in FIGS. 2 to 4, this volume pick-up comprises a gauge blade 220 disposed in the mouthpiece outlet 34 and connected to the computer disposed in the housing 49 and controlling the electromagnetic relay (connection schematically represented at 50 in FIGS. 1 to 4).

The operation of the apparatus 10 will now be described with reference to FIGS. 1 to 6.

Figure 5:
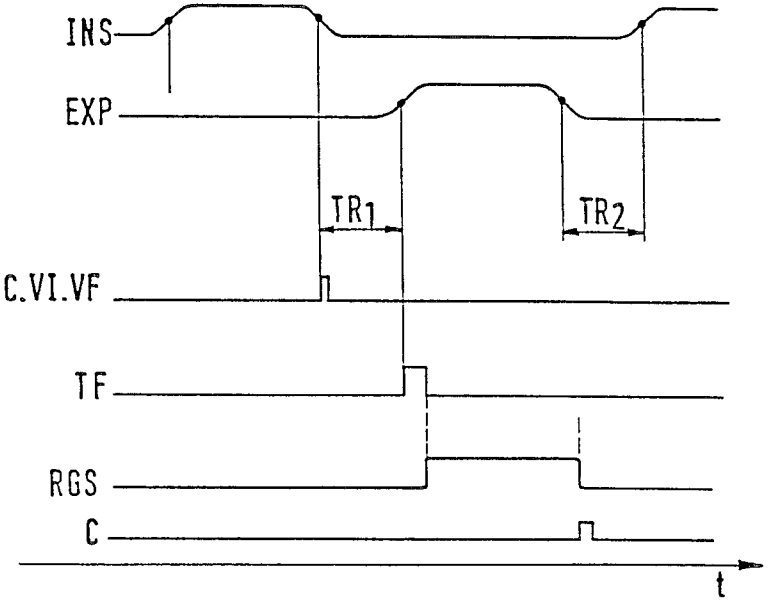
FIG. 5 represents a diagram of the times of operation of the apparatus according to the present invention.

FIG. 5 is a schematic representation of the times involved in the course of a normal cycle of breathing of a diver. Such a normal cycle comprises an inhaling phase INS and an exhaling phase EXP. The inhaling phase is separated from the exhaling phase by a first time rest $TR_1$ while the exhaling phase is separated from the following inhaling phase by a second time rest $TR_2$.

Figure 6:
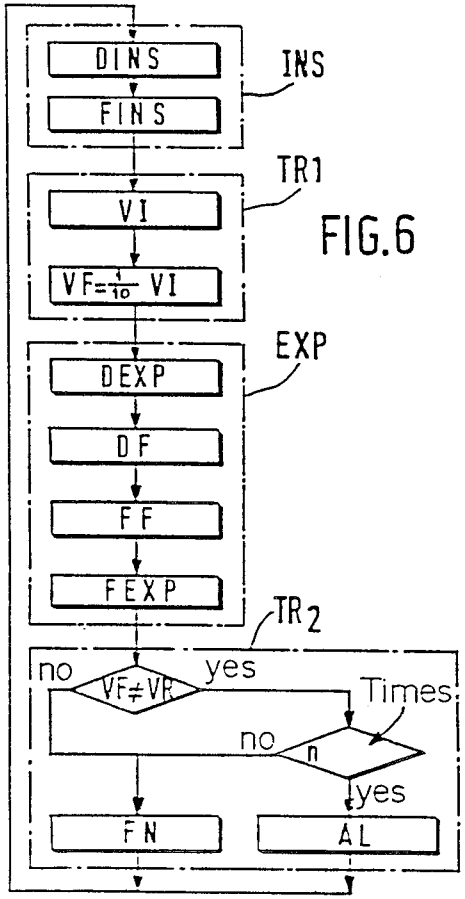
FIG. 6 is a chart showing the operation of a computer for the apparatus according to the present invention.

FIG. 6 is an example of an operating chart for the operation of the computer 24: the operating phases being represented in full lines, while the breathing phases mentioned above are represented in mixtilinear lines.

During the inhaling phase INS, in FIGS. 1, 2, 5, 6, the mixture which exits from the breathing bag 13 arrives in the inhaling duct 32 by following the inhaling circuit 16 including inhaling valve 18. In the drainage mouthpiece 30, following a pressure decrease resulting from inhaling by the diver, the air follows a path represented by arrow 50*a* between the inhaling duct 32 and the mouthpiece outlet 34.

During this phase of inhaling, the gauge blade 220 of the volume pick-up 22 is deformed to take the position represented in FIG. 2. This deformation is proportional to the speed of the gas through the mouthpiece outlet 34. Knowing the cross section of the outlet the volume of gas which circulates and is intended to be inhaled can be determined. The computer 24, connected to said gauge blade 220 of the volume pick-up 22, FIG. 1, has then reached the detection step DINS of the inhaling phase and can sample, in well known manner, the point by point deformation of the blade during this step.

Between the end FINS of the inhaling period INS and the exhaling period EXP (FIG. 5), during the first time rest $TR_1$, which lasts a few tenths of a second, the computer gives the volume of gas V1 effectively inhaled during the inhaling period INS and calculates the volume of gas exhaled which should be allowed to escape or leak VF, during the following exhaling period.

In this example, the volume of exhaled gas which should be allowed to escape VF is equal to a tenth of the volume of gas previously inhaled. In this embodiment, the computed time is 1/1000 sec. (see FIG. 5, diagram C VI VF).

At the start of the exhaling phase EXP, which is detected by the computer at DEXP, the computer maintains the shutter plate 39 in low position against the joint 38, so that the gas which is exhaled follows a path which is schematically represented in FIG. 3 by means of the arrows 50*b*, between the mouthpiece outlet 34 and the leaking outlet 35. This gas enters outlet 35 through openings 41 of cylinder 40, and pushes back the exhaling valve 23 when the exhaling pressure is sufficient.

As soon as the exhaling has started, the computer 24 realizes that there is a leak since the shutter 39 remains in low or "rest" position (step DF). During the time when there is a leak TF, FIG. 5, the computer samples the deformation of the gauge blade 220 and thereby determines the volume of gas VR which effectively leaks out.

As soon as the volume VR, which leaks out, reaches a value which is substantially near the volume of gas to be allowed to leak VF previously calculated, the computer orders the opening of the electromagnetic relay 21 and the shutter plate 39 sets up in working position against the joint 48 (FIG. 4). The gas which has been exhaled then follows a path schematically represented by the arrows 50*c*. This is the step referred to as the end of the leak FF in FIG. 6. When the exhaling FEXP is over, during the second time rest $TR_2$, the gauge blade goes back to a substantially horizontal position detected by the computer 24.

During the second time rest $TR_2$, the computer compares the volume of gas to be allowed to leak VF which is calculated during the inhaling phase and the volume of gas VR which has really leaked out. If these values are similar, the apparatus FN operates normally and another cycle can start again. If these values are different and this takes place during a number of breathing cycles higher than a predetermined number n (for example 10), an alarm AL is then given and the electromagnetic sluice gate 21 is blocked in leaking position as represented in FIGS. 2, 3.

FIG. 5 illustrates the normal operation of the apparatus, at the start of the exhaling, where there is a leak (TF). As soon as the leak is over, the gas returns to the bag 13 (RGS).

FIG. 5 also schematically represents a diagram of the time for the control C of the operation of the apparatus during the second time rest $TR_2$.

Figure 7:
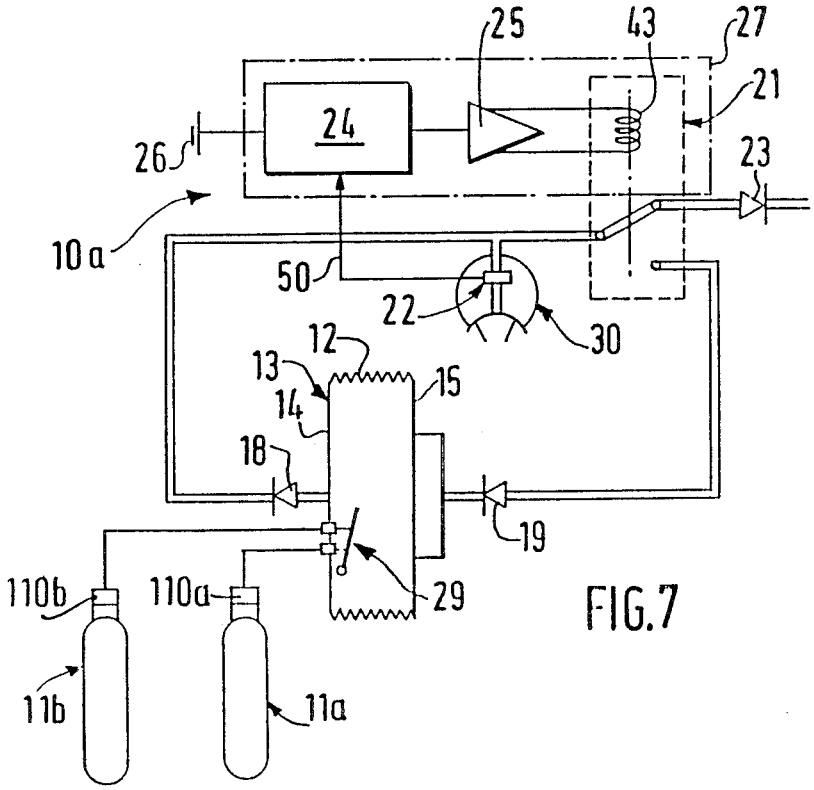
FIG. 7 is a schematic view corresponding to FIG. 1 illustrating another embodiment of the apparatus according to the present invention.

FIG. 7 represents a modified embodiment 10*a* of the apparatus according to the present invention, in which there are used a bottle of oxygen 11*a* and a bottle of inert gas such as nitrogen 11*b*. These bottles are provided with reducing valves comprising a device 110*a*, 110*b* permitting the introduction of a mixture of gas in the bag 13, so that the partial pressure of oxygen is always maintained between the so called security values, whatever the depth at which the diver is operating. Such reducing valves 110*a* and 110*b* can be of the same type as described in French patent No. 2,491,428.

Of course, the invention is not limited to the various embodiments described and represented, but encompasses any modification in the performance and/or carrying out of the invention.

In particular, it should be noted that the volume of gas which is allowed to leak VF can vary to a large extent. An expert in the art knows very well that when he uses bottles containing a mixture of oxygen and inert gas in predetermined amounts, depending on the depth where the work is carried out, the smaller the leak, the greater the quantity of inert gas in the breathing bag and, consequently, the mixture in the bottle should therefore be superoxygenated with respect to the depth at which the work under consideration is carried out. On the contrary, if the leak is particularly serious, the rate of oxygen in the breathing bag approaches that of the mixture. The mixture can then be normally oxygenated depending on the depth of the working operation.

It should also be underlined that the drainage mouthpiece described with reference to FIGS. 2 to 4 can comprise a mechanical system for manually blocking the shutter plate 39 in working or rest position, in case of a failure of the electromechanical system.

Figure 8:
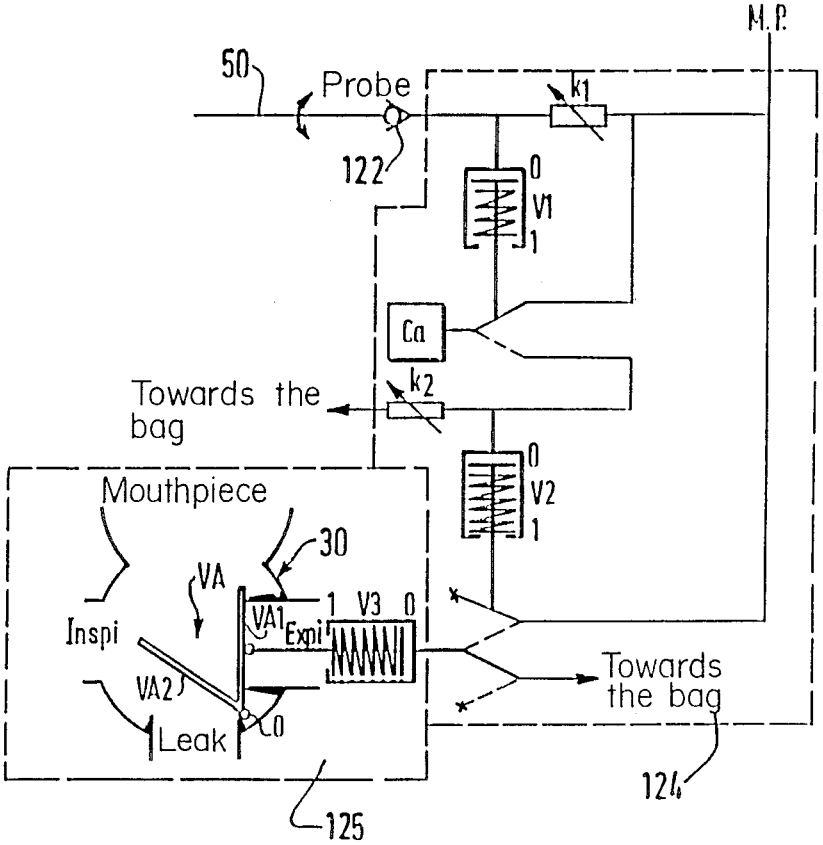
FIGS. 8 and 9 represent a pneumatic variant of an embodiment according to the invention.
Figure 9:
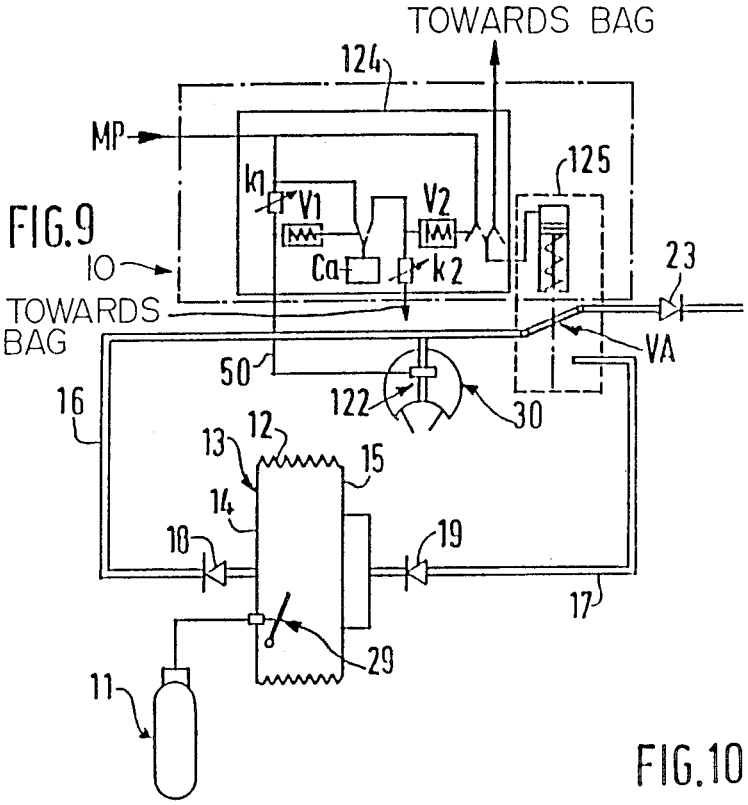
Figure 10:
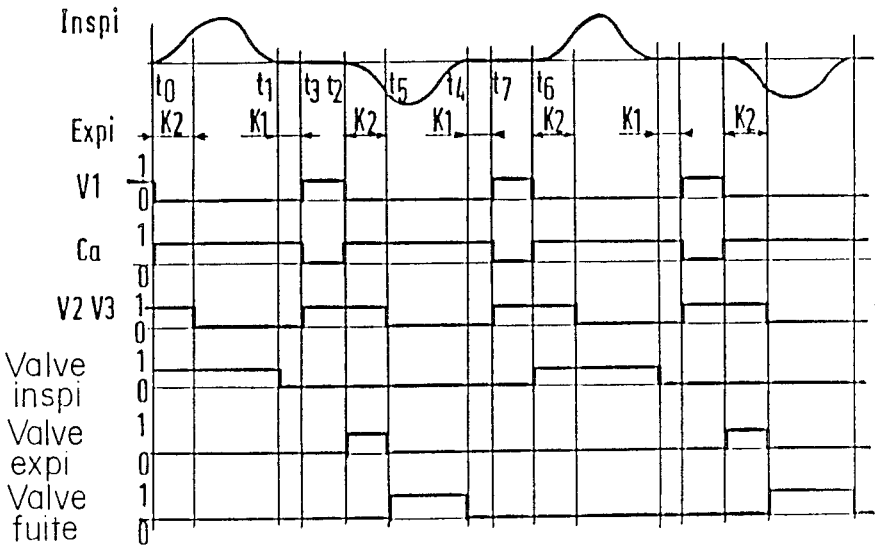
FIG. 10 is a diagram of the logic levels versus time concerning the device of FIGS. 8 and 9.

FIGS. 8, 9 and 10 represent a pneumatic modification of the invention. The simplified illustration of FIG. 8 comprises:

a probe 122 Pa1 located in the mouthpiece 30 which generates a leak when inhaling or exhaling. This probe can be a device known under the designation "tilt" or any other similar device. It is connected, via 50 to K1 and V1.

an adjustable sprinkler K1 which is set as a function of the breathing cycle.

a distributor 3/2 (three openings-two positions) connected to the source of gas at average pressure M.P., for feeding the volume Ca requested by the jack V1.

an adjustable sprinkler K2 which controls the percentage of gas to be expelled outside.

a distributor 5/2 (five positions-two openings) connected to the source of gas at average pressure M.P., which feeds the jack V3 which controls the valve VA located in the mouthpiece. The distributor 5/2 is controlled by the jack V2.

the valve VA made of two flat valve members $Va_1$ and $VA_2$ forming an acute angle, as viewed in FIG. 8. $VA_1$ is connected to the jack V3. When V3 is being emptied, $VA_1$ closes the exhaling duct "Expi". When V3 is filled, the valve members pivot about hinge member O and $VA_2$ comes to close the leaking duct "Leak". All the jacks are of the single effect type.

FIG. 9 illustrates the pneumatic embodiment of the device of FIG. 1, the same elements being referred to by the same reference numerals. With respect to that figure, the computer 24 (electric means) has been replaced by a pneumatic means 124 which pneumatically produces a similar function (with a supply of air under average pressure M.P. instead of an electrical supply), while the amplifier 25 and the control coil 43 associated with the electromagnet which is part of the electromagnetic relay 21 have been replaced by the assembly 125 comprising for example the jack V3 acting on the valve VA to ensure, as the case may be, the switching in "leaking" position or "towards the bag" of the air exhaled by the diver. The means 124 and 125 are represented in detail in FIG. 8. Finally, the probe 122 Pa1 of FIG. 8 has been substituted for the probe 22 of FIG. 1.

The operation of the device of FIGS. 8 and 9 will be better understood with reference to the chart of FIG. 10 representing the logic levels in various points of the diagram as a function of time.

The diver inhales from t0 to t1:

The probe Pa1 produces a leak and the jack V1 empties, thereby proceeding to step 0;

Jack V1 being at step 0, the capacity Ca is filled;

V2 and V3 empty with a delay K2 (as hereinafter between t2 and t4).

The diver stops inhaling from t1 to t2:

The probe Pa1 closes and the jack V1 is filled from t3 with a certain delay due to K1;

Jack V1 proceeds to step 1, the capacity Ca is emptied in V2 which causes V3 to proceed to step 1 (V3 is filled).

The diver exhales from t2 to t4:

The probe Pa1 produces a leak and the jack V1 is emptied and thereby proceeds to step 0;

Jack V1 being at step 0, the capacity Ca is filled;

At the same time, jack V2 is emptied, from t5 with a delay due to K2. As long as the jack V2 is not empty, the mixture exhaled by the diver is directed towards the purifying cartridge ("towards the bag"). When the jack V2 is empty, it proceeds to step 0, the jack V3 thereby proceeds to step 0, and the exhaled mixture is directed towards the outside ("leak").

The diver stops exhaling from t4 to t6 (=t0):

The operation is identical to that described between t1 and t2, then the cycle starts again.

We claim:

1. Breathing apparatus for diving comprising: a breathing bag, a mouthpiece, and inhaling and exhaling ducts connected to the bag and to the mouthpiece, said inhaling and exhaling ducts being respectively provided with inhaling and exhaling non return valves and a drainage device having a drainage outlet; wherein said breathing apparatus comprises means communicating with the inhaling and exhaling ducts for measuring the volume of gas inhaled and exhaled, said drainage device comprising switching means movable between an "operating" position and a "rest" position, said switching means in said "operating" position directing flow towards the exhaling valve and in said "rest" position directing flow toward the drainage outlet.

2. Breathing apparatus according to claim 1, wherein the drainage device is disposed in the mouthpiece.

3. Breathing apparatus according to claim 1, further comprising: means connected to said measuring means and to said switching means said control means being adapted to control said switching means so that the flow is directed towards the exhaling valve when a determined fraction of the volume of exhaled gas has been evacuated by the drainage device.

4. Breathing apparatus according to claim 3, wherein the control means comprises electronic means including a computer adapted to determine said fraction of the volume of exhaled gas.

5. Breathing apparatus according to claim 1, wherein the switching means comprises an electromagnetic relay; and shutter means controlled by said relay for opening and closing the exhaling duct and said drainage outlet.

6. Breathing apparatus according to claim 5, wherein the shutter means comprises a shutter plate and a cylindrical structure rigidly affixed to the shutter pate and having openings therein, said electromagnetic relay including a coil and an annularly shaped magnetic core, said cylindrical structure being mounted on said magnetic core.

7. Breathing apparatus according to claim 1, in which the measuring means comprises a single volume measuring device for inhaling and exhaling gas.

8. Breathing apparatus according to claim 7, wherein said device for measuring the volume of gas (220) comprises a stress gauge blade (220).

9. Breathing apparatus according to claim 1, wherein the switching means comprises a piston and a shutter controlled by the piston for opening and closing the exhaling duct and the drainage outlet.

* * * * *